United States Patent [19]

Faulring

[11] Patent Number: 4,526,613

[45] Date of Patent: Jul. 2, 1985

[54] PRODUCTION OF ALLOY STEELS USING CHEMICALLY PREPARED $V_2O_3$ AS A VANADIUM ADDITIVE

[75] Inventor: Gloria M. Faulring, Niagara Falls, N.Y.

[73] Assignee: Union Carbide Corporation, Danbury, Conn.

[21] Appl. No.: 588,411

[22] Filed: Mar. 12, 1984

[51] Int. Cl.[3] ..... C22B 4/00

[52] U.S. Cl. ..... 75/12; 75/10; 75/129

[58] Field of Search ..... 75/10 R, 12, 59, 60, 75/129

[56] References Cited

U.S. PATENT DOCUMENTS

| | | | |
|---|---|---|---|
| 3,046,107 | 7/1962 | Nelson | 75/59 |
| 3,410,652 | 11/1968 | Hausen et al. | 23/21 |
| 3,591,367 | 7/1971 | Perfect | 75/133 |
| 4,361,442 | 11/1982 | Faulring et al. | 75/57 |
| 4,396,425 | 8/1983 | Faulring | 75/129 |

*Primary Examiner*—Peter D. Rosenberg
*Attorney, Agent, or Firm*—John R. Doherty

[57] ABSTRACT

Process for producing alloy steels wherein a vanadium additive consisting essentially of chemically prepared, substantially pure $V_2O_3$ is added to molten steel as a vanadium additive. The production of the alloy steel involves specifically the use of the $V_2O_3$ as a vanadium additive in an argon-oxygen-decarburization (AOD) process.

8 Claims, 6 Drawing Figures

FIG. 3
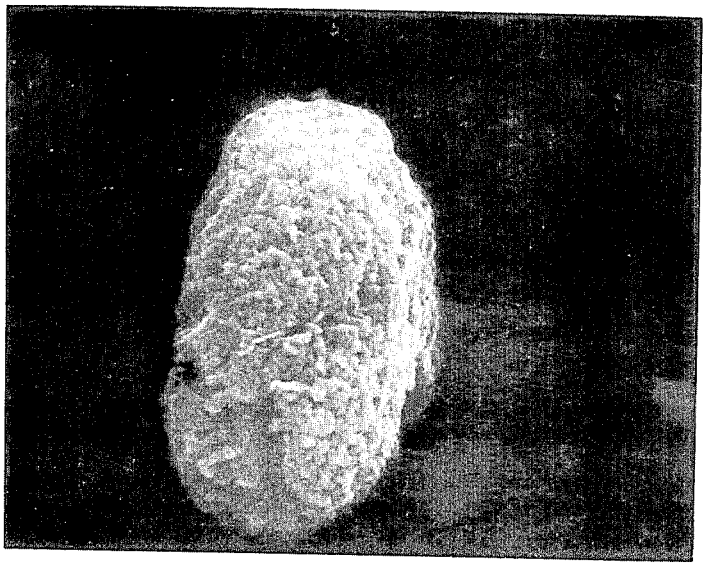
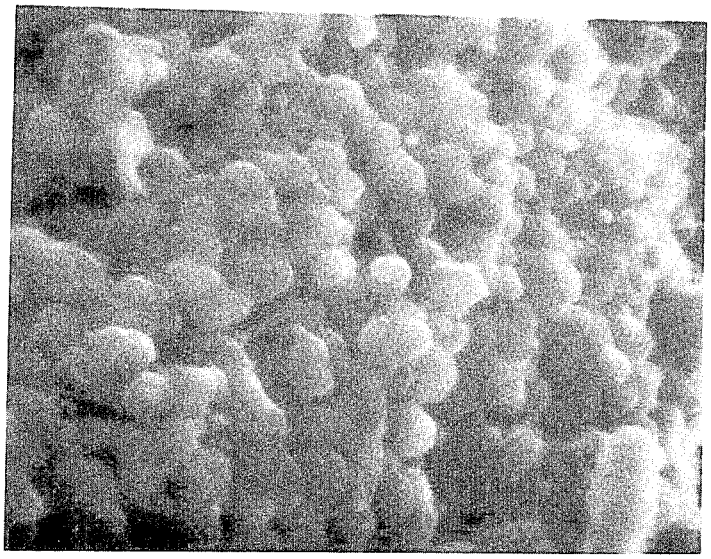
FIG. 4

PARTICLE SIZE DISTRIBUTION OF $V_2O_3$

PRODUCTION OF ALLOY STEELS USING CHEMICALLY PREPARED $V_2O_3$ AS A VANADIUM ADDITIVE

BACKGROUND OF THE INVENTION

1. Field of the Invention

The present invention relates to alloy steels and more particularly to a process for producing alloy steels using chemically prepared, substantially pure vanadium trioxide, $V_2O_3$, as a vanadium additive. In a more specific aspect, the invention relates to the production of alloy steels using a $V_2O_3$ additive in the argon-oxygen-decarburization (AOD) process.

Throughout the specification and claims, reference will be made to the term "chemically prepared $V_2O_3$". This vanadium trioxide is prepared according to the teachings of D. M. Hausen et. al, in U.S. Pat. No. 3,410,652 issued on Nov. 12, 1968, the disclosure of which is incorporated herein by reference. As described in that patent, $V_2O_3$ is produced by a process wherein a charge of ammonium metavanadate (AMV) is thermally decomposed in a reaction zone at elevated temperatures (e.g. 580° C. to 950° C.) in the absence of oxygen. This reaction produces gaseous by-products which provide a reducing atmosphere. The $V_2O_3$ is formed by maintaining the charge in contact with this reducing atmosphere for a sufficient time to complete the reduction. The final product is substantially pure $V_2O_3$ containing less than 0.01 percent nitride. $V_2O_3$ is the only phase detectable by X-ray diffraction.

2. Description of the Prior Art

It is common practice to alloy steel with vanadium by adding ferrovanadium or vanadium carbide (VC-$V_2C$) to the molten steel. The ferrovanadium is commonly produced by the aluminothermal reduction of vanadium pentoxide ($V_2O_5$) or by the reduction of a vanadium-bearing slag or vanadium-bearing residue, for example. Vanadium carbide is usually made in several stages, i.e., vanadium pentoxide or ammonium vanadate is reduced to vanadium trioxide, $V_2O_3$, which in turn is reduced in the presence of carbon to vanadium carbide under reduced pressure at elevated temperatures (e.g. about 1400° C.). A commercial VC-$V_2C$ additive is produced by Union Carbide Corporation under the trade name "Caravan".

Vanadium additions have also been made by adding vanadium oxide, e.g. $V_2O_5$ or $V_2O_3$, to the molten steel along with a reducing agent. For example, U.S. Pat. No. 4,361,442 issued to G. M. Faulring et. al on Nov. 30, 1982, discloses a process for adding vanadium to steel wherein an addition agent consisting of an agglomerated mixture of finely divided $V_2O_5$ and a calcium-bearing material, e.g. calcium-silicon alloy, is added to the molten steel preferably in the form of a molded briquet.

U.S. Pat. No. 4,396,425 issued to G. M. Faulring et. al on Aug. 2, 1983 discloses a similar process for adding vanadium to steel wherein the addition agent is an agglomerated mixture of finely divided $V_2O_3$ and calcium-bearing material.

U.S. Pat. No. 3,591,367 issued to F. H. Perfect on July 6, 1971, discloses a vanadium addition agent for use in producing ferrous alloys, which comprises a mixture of vanadium oxide, e.g. $V_2O_5$ or $V_2O_3$, an inorganic reducing agent such as Al or Si, and lime. The purpose of the lime is to flux inclusions, e.g. oxides of the reducing agent, and to produce low melting oxidic inclusions that are easily removed from the molten steel.

Vanadium addition agents of the prior art, while highly effective in many respects, suffer from a common limitation in that they often contain residual metals which can be harmful or detrimental to the steel. Even in those cases where the addition agent employs essentially pure vanadium oxide e.g. $V_2O_3$, the reducing agent usually contains a significant amount of metallic impurities.

In the copending application Ser. No. 588,412 of G. M. Faulring filed on even date herewith, and assigned to the common assignee hereof, an improved process for producing tool steel is disclosed wherein a chemically prepared, substantially pure $V_2O_3$ is added, without a reducing agent, to a molten steel having a carbon content above about 0.35 weight % and containing silicon as an alloy element. A slag is provided covering the molten metal which is essentially basic, that is, the slag has a V-ratio, i.e., CaO to $SiO_2$, which is greater than unity. The slag may also be rendered reducing by addition of a reducing material such as carbon, silicon or aluminum.

SUMMARY OF THE INVENTION

The present invention comprehends an improved process for producing alloy steel which is an alternative to the process disclosed in the copending application of G. M. Faulring, supra, and wherein chemically prepared, substantially pure $V_2O_3$ can be added to the molten steel without a reducing agent.

In accordance with the present invention, there is provided a novel and improved process for producing alloy steel which comprises:

(a) forming a molten alloy steel in an electric furnace;

(b) pouring the molten steel from the electric furnace into a transfer ladle;

(c) loading the molten steel from the transfer ladle into an AOD vessel;

(d) adding to the molten steel in the electric furnace, transfer ladle or AOD vessel a vanadium additive consisting essentially of chemically prepared, substantially pure $V_2O_3$;

(e) generating a slag covering the molten steel in the AOD vessel, the slag containing CaO and $SiO_2$ in a weight ratio of $CaO/SiO_2$ which is equal to or greater than unity;

(f) adding to the molten steel in the AOD vessel an oxidizable metal selected from the group consisting of aluminum and silicon or mixtures thereof; and (g) injecting a gaseous mixture of argon or nitrogen or both and oxygen into the AOD vessel, the proportion of argon or nitrogen to oxygen in the gaseous mixture being such as to continuously provide a reducing atmosphere in contact with the molten steel.

It has been surprisingly found in accordance with the present invention that a chemically prepared, substantially pure $V_2O_3$ can be successfully added to a molten alloy steel without a reducing agent to achieve a given level of vanadium addition if the molten steel is continuously exposed to the reducing, non-equilibrium conditions prevailing in the AOD process. In the AOD process, the proportion of argon or nitrogen in the gaseous mixture promotes the formation of CO and $CO_2$ which are then continuously removed from contact with the molten steel by the voluminous injection of the inert gas-oxygen mixture. The AOD vessel is maintained at steel-making temperatures by the oxidation of the aluminum or silicon or both.

A detailed explanation of the AOD process is given in U.S. Pat. No. 3,252,798 issued to W. A. Krivsky on May 24, 1966, the disclosure which is incorporated herein by reference.

The use of chemically prepared $V_2O_3$ as a vanadium additive in accordance with the present invention has many advantages over the prior art. First, the $V_2O_3$ is nearly chemically pure, i.e. greater than 97% $V_2O_3$. It contains no residual elements that are detrimental to the steel. Both ferrovanadium and vanadium carbide contain impurities at levels which are not found in chemically prepared $V_2O_3$. Vanadium carbide, for example, is produced from a mixture of $V_2O_3$ and carbon and contains all the contaminants that are present in the carbon as well as any contaminants incorporated during processing. Moreover the composition and physical properties of chemically prepared $V_2O_3$ are more consistent as compared to other materials. For example, $V_2O_3$ has a fine particle size which varies over a narrow range. This does not apply in the case of ferrovanadium where crushing and screening are required resulting in a wide distribution of particle size and segregation during cooling producing a heterogeneous product. Finally, the reduction of $V_2O_3$ in the AOD process is an exothermic reaction, supplying heat to the molten steel. $V_2O_3$ also provides a source of oxygen for fuel allowing a reduction in the amount of oxygen injected. Ferrovanadium and vanadium carbide both require the expenditure of thermal energy in order to integrate the vanadium into the molten steel.

BRIEF DESCRIPTION OF THE DRAWING

In the accompanying drawing:

FIG. 3 is a photomicrograph taken at a magnification of 10,000× and showing the structure in greater detail of a small particle of $V_2O_3$ shown in FIG. 1;

FIG. 4 is a photomicrograph taken at a magnification of 50,000× and showing the structure in greater detail of the small $V_2O_3$ particle shown in FIG. 3;

DESCRIPTION OF THE PREFERRED EMBODIMENTS

Figure 1:
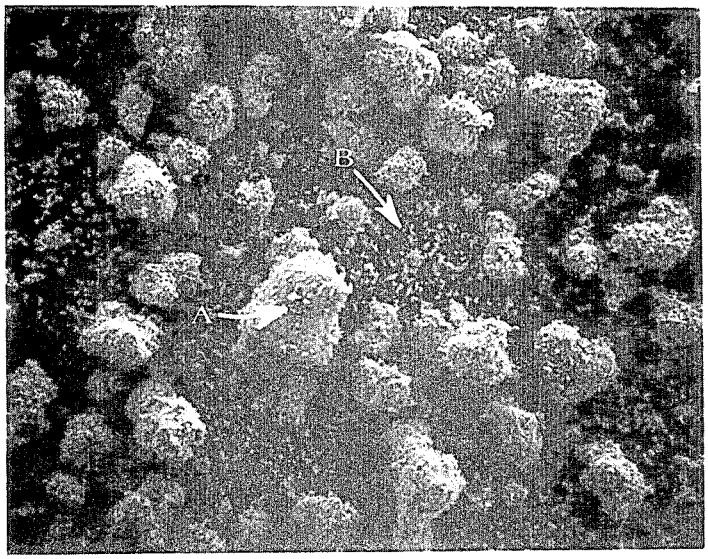
FIG. 1 is a photomicrograph taken at a magnification of 100× and showing a chemically prepared $V_2O_3$ powder used as a vanadium additive according to the present invention.

Alloy steels are commonly made with an argon-oxygen decarburization (AOD) processing step which occurs after the charge has been melted down in the electric furnace. The molten steel is poured into a ladle and then transferred from the ladle to the AOD vessel. An argon-oxygen mixture is continuously injected into the AOD vessel at high velocities for periods of up to about 2 hours. After processing in the AOD, the molten steel is then cast into ingots or a continuous caster.

In the practice of the present invention, a vanadium additive consisting essentially of chemically prepared $V_2O_3$ produced according to Hausen et al in U.S. Pat. No. 3,410,652, supra, is added to a molten tool steel as a finely divided powder or in the form of briquets, without a reducing agent, within the electric furnace, the transfer ladle or the AOD vessel. The composition of the alloy steel is not critical. The steel may have a low or high carbon content and may employ any number of other alloying elements in addition to vanadium such as, for example, chromium, tungsten, molybdenum, manganese, cobalt and nickel as will readily occur to those skilled in the art.

It is preferred in the practice of the present invention to provide a basic reducing slag covering the molten steel. The slag is generated according to conventional practice by the addition of slag formers such as lime, for example, and consists predominately of CaO and $SiO_2$ along with smaller quantities of FeO, $Al_2O_3$, MgO and MnO, for example. The proportion of CaO to $SiO_2$ is known as the "V-ratio" which is a measure of the basicity of the slag.

It has been found that in order to obtain recoveries of vanadium which are close to 100% using chemically prepared $V_2O_3$ as an additive, the V-ratio of the slag must be equal to or greater than 1.0. Preferably, the V-ratio is between about 1.3 and 1.8. Suitable modification of the slag composition can be made by adding lime in sufficient amounts to increase the V-ratio at least above unity. A more detailed explanation of the V ratio may be found in "Ferrous Productive Metallurgy" by A. T. Peters, J. Wiley and Sons, Inc. (1982), pages 91 and 92.

The chemically prepared $V_2O_3$ that is used as a vanadium additive in the practice of this invention is primarily characterized by its purity i.e. essentially 97–99% $V_2O_3$ with only trace amounts of residuals. Moreover, the amounts of elements most generally considered harmful in the steel-making process, namely, arsenic, phosphate and sulfur, are extreme low. In the case of tool steels which contain up to 70 times more vanadium than other grades of steel, the identity and amount of residuals is particularly important.

Table I below shows the chemical analyses of a typical chemically prepared $V_2O_3$ material:

TABLE I

Chemical Analyses of $V_2O_3$

| Element or Compound | Weight Percent Typical | Weight Percent Maximum |
|---|---|---|
| V | 66.1 (97.2% $V_2O_3$) | 67 (98.6% $V_2O_3$) |
| Alkali ($Na_2O_3$ + $K_2O$) | 0.3– | 1.0 |
| As | | 0.01 |
| Cu | | 0.05 |
| Fe | | 0.1 |
| Mo | | 0.05 |
| P | | 0.03 |
| $SiO_2$ | | 0.25 |
| S | | 0.02 |

X-ray diffraction data obtained on a sample of chemically prepared $V_2O_3$ shows only one detectable phase, i.e. $V_2O_3$. Based on the lack of line broadening or intermittent-spotty X-ray diffraction reflections, it was concluded that the $V_2O_3$ crystallite size is between $10^{-3}$ and $10^{-5}$ cm.

The chemically prepared $V_2O_3$ is also very highly reactive. It is believed that this reactivity is due mostly to the exceptionally large surface area and porosity of the $V_2O_3$. Scanning electron microscope (SEM) images were taken to demonstrate the high surface area and porosity of the $V_2O_3$ material. FIGS. 1–4, inclusive, show these SEM images.

FIG. 1 is an image taken at 100× magnification on one sample of $V_2O_3$. As shown, the $V_2O_3$ is characterized by a agglomerate masses which vary in particle size from about 0.17 mm and down. Even at this low magnification, it is evident that the larger particles are agglomerates of numerous small particles. For this reason, high magnification SEM images were taken on one large particle designated "A" and one small particle designated "B".

Figure 2:
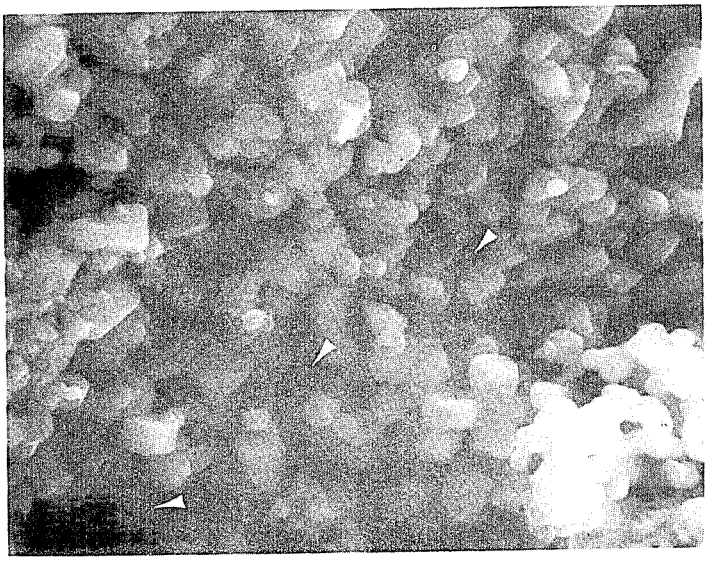
FIG. 2 is a photomicrograph taken at a magnification of 10,000× and showing in greater detail the structure of a large particle of $V_2O_3$ shown in FIG. 1.

The SEM image on the large particle "A" is shown in FIG. 2. It is apparent from this image that the large particle is a porous agglomerated mass of extremely small particles, e.g. 0.2 to 1 micron. The large amount of nearly black areas (voids) on the SEM image is evidence of the large porosity of the $V_2O_3$ masses. See particularly the black areas emphasized by the arrows in the photomicrographs. It will also be noted from the images that the particles are nearly equidimensional.

FIG. 3 is an image taken at 10,000× magnification of the small particle "B". The small particle or agglomerate is about 4×7 microns in size and consists of numerous small particles agglomerated in a porous mass. A higher magnification image (50,000×) was taken of this same small particle to delineate the small particles of the agglomerated mass. This higher magnification image is shown in FIG. 4. It is evident from this image that the particles are nearly equidimensional and the voids separating the particles are also very much apparent. In this agglomerate, the particles are in a range of about 0.1 to 0.2 microns.

Figure 5:
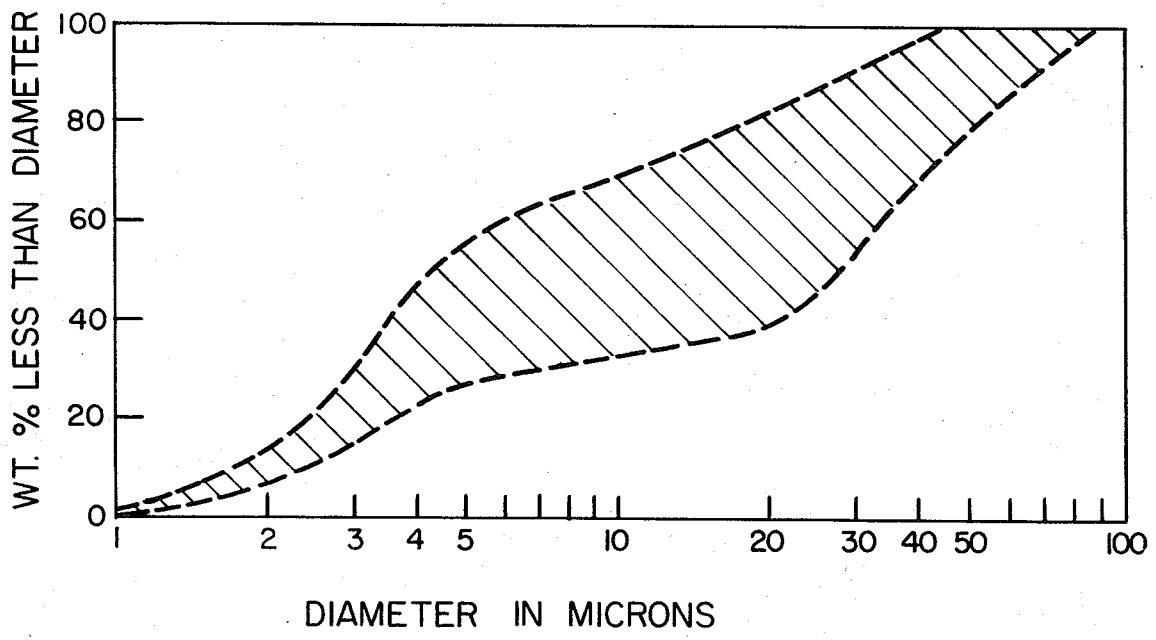
FIG. 5 is a graph showing the particle size distribution typical of chemically prepared $V_2O_3$ powders.

FIG. 5 shows the particle size distribution of chemically prepared $V_2O_3$ material from two different sources. The first $V_2O_3$ material is that shown in FIGS. 1–4. The second $V_2O_3$ material has an idiomorphic shape due to the relatively slow recrystallization of the ammonium metavanadate. The size of the individual particle is smaller in the case of the more rapidly recrystallized $V_2O_3$ and the shape is less uniform.

The particle size was measured on a micromerograph and the particles were agglomerates of fine particles (not separated-distinct particles). It will be noted from the graph that 50 wt. % of all the $V_2O_3$ had a particle size distribution of between 4 and 27 microns.

The bulk density of the chemically prepared $V_2O_3$ prior to milling is between about 45 and 65 lb/cu.ft. Preferably, $V_2O_3$ is milled to increase its density for use as a vanadium additive. Milling produces a product that has a more consistent density and one that can be handled and shipped at lower cost. Specifically, the milled $V_2O_3$ has a bulk density of about 70 to 77 lb/cu. ft.

The porosity of the chemically prepared $V_2O_3$ has been determined from the measured bulk and theoretical densities. Specifically, it has been found that from about 75 to 80 percent of the mass of $V_2O_3$ is void. Because of the minute size of the particles and the very high porosity of the agglomerates, chemically prepared $V_2O_3$ consequently has an unusually large surface area. The reactivity of the chemically prepared $V_2O_3$ is related directly to this surface area. The surface area of the $V_2O_3$ calculated from the micromerograph data is 140 square feet per cubic inch or 8,000 square centimeters per cubic centimeter.

Aside from its purity and high reactivity, chemically prepared $V_2O_3$ has other properties which make it ideal for use as a vanadium additive. For instance, $V_2O_3$ has a melting point (1970° C.) which is above that of most steels (1600° C.) and is therefore solid and not liquid under typical steel-making additions. Moreover, the reduction of $V_2O_3$ in the AOD under steel-making conditions is exothermic. In comparison, vanadium pentoxide ($V_2O_5$) also used as a vanadium additive together with a reducing agent, has a melting point (690° C.) which is about 900° C. below the temperature of molten steel and also requires more stringent reducing conditions to carry out the reduction reaction. A comparison of the properties of both $V_2O_3$ and $V_2O_5$ is given in Table II below:

TABLE II

Comparison of Properties of $V_2O_5$ and $V_2O_3$

| Property | $V_2O_3$ | $V_2O_5$ |
|---|---|---|
| Density | 4.87 | 3.36 |
| Melting Point | 1970° C. | 690° C. |
| Color | Black | Yellow |
| Character of Oxide | Basic | Amphoteric |
| Composition | 68% V + 32% O | 56% V + 44% O |
| Free Energy of Formation (1900° K.) | −184,500 cal/mole | −202,000 cal/mole |
| Crystal Structure | $a_o = 5.45 \pm 3A$<br>$\alpha = 53°49' \pm 8'$<br>Rhombohedral | $a_o = 4.369 \pm 5A$<br>$b_o = 11.510 \pm 8A$<br>$c_o = 3.563 \pm 3A$<br>Orthohrombic |

In further comparison, $V_2O_5$ is considered a strong flux for many refractory materials commonly used in electric furnaces and ladles. In addition, $V_2O_5$ melts at 690° C. and remains a liquid under steel-making conditions. The liquid $V_2O_5$ particles coalesce and float to the metal-slag interface where they are diluted by the slag and react with basic oxides, such as CaO and $Al_2O_3$. Because these phases are difficult to reduce and the vanadium is distributed throughout the slag volume producing a dilute solution, the vanadium recovery from $V_2O_5$ is appreciably less than from the solid, highly reactive $V_2O_3$.

Since chemically prepared $V_2O_3$ is both solid and exothermic under steel-making conditions, it will be evident that the particle size of the oxide and consequently the surface area are major factors in determining the rate and completeness of the reduction. The speed of the reaction is maximized under the reducing conditions prevailing in the AOD vessel, that is, extremely small particles of solid $V_2O_3$ distributed throughout a molten steel bath. These factors contribute to create ideal conditions for the complete and rapid reduction of $V_2O_3$ and solubility of the resulting vanadium in the molten steel.

As indicated earlier, the V-ratio is defined as the % CaO/%$SiO_2$ ratio in the slag. Increasing the V-ratio is a very effective way of lowering the activity of $SiO_2$ and increasing the driving force for the reduction reaction of Si. The equilibrium constant K for a given slag-metal reaction when the metal contains dissolved Si and O under steel-making conditions (1600° C.) can be determined from the following equation:

$$K = \frac{a\ SiO_2}{(a\ Si)(a\ O)^2} = 28997$$

wherein "K" equals the equilibrium constant; "a $SiO_2$" equals the activity of the $SiO_2$ in the slag; "a Si" equals the activity of the Si dissolved in the molten metal, and "a O" equals the activity of oxygen also dissolved in the molten metal.

For a given V-ratio, the activity of the silica can be determined from a standard reference such as "The AOD Process"—Manual for AIME Educational Seminars, as set forth in Table III below. Based on these data are published equilibrium constants for the oxidation of silicon and vanadium, the corresponding oxygen level for a specified silicon content can be calculated. Under these conditions, the maximum amount of $V_2O_3$ that can be reduced and thus the amount of vanadium dissolved in the molten metal can also be determined.

TABLE III

| Effect of V-ratio on "a $SiO_2$" | |
|---|---|
| V-ratio | a $SiO_2$ |
| 0 | 1.00 |
| 0.25 | 0.50 |
| 0.50 | 0.28 |
| 0.75 | 0.20 |
| 1.00 | 0.15 |
| 1.25 | 0.11 |
| 1.50 | 0.09 |
| 1.75 | 0.08 |
| 2.00 | 0.07 |

Table IV below shows the V-ratios for decreasing $SiO_2$ activity and the corresponding oxygen levels. The amount of $V_2O_3$ reduced and vanadium dissolved in the molten steel are also shown for each V-ratio.

TABLE IV

| Slag | | Steel* | | |
|---|---|---|---|---|
| Slag V Ratio (% CaO/% $SiO_2$) | a $SiO_2$** | Oxygen Content of Steel 0 (ppm) | V Dissolved in Steel % | Amount of $V_2O_3$ Reduced % |
| 0 (acid slag) | 1.0 | 107 | 1.2 | 1.8 |
| 1.00 | 0.15 | 41 | 5.04 | 7.5 |
| 1.25 | 0.11 | 36 | 6.24 | 9.3 |
| 2.00 | 0.07 | 28 | 8.93 | 13.3 |

*Steel contains 0.3 wt. % silicon.
**Reference - "The AOD Process" - Manual for AIME Educational Seminar.

Thus, from the above calculations based on a steel containing 0.3 weight percent Si and a variable V-ratio, it may be concluded that with an increase in the V-ratio from 1 to 2, there is a 1.8 times increase in the amount of vanadium that can be reduced from the $V_2O_3$ and incorporated into the molten steel at 1600° C.

Figure 6:
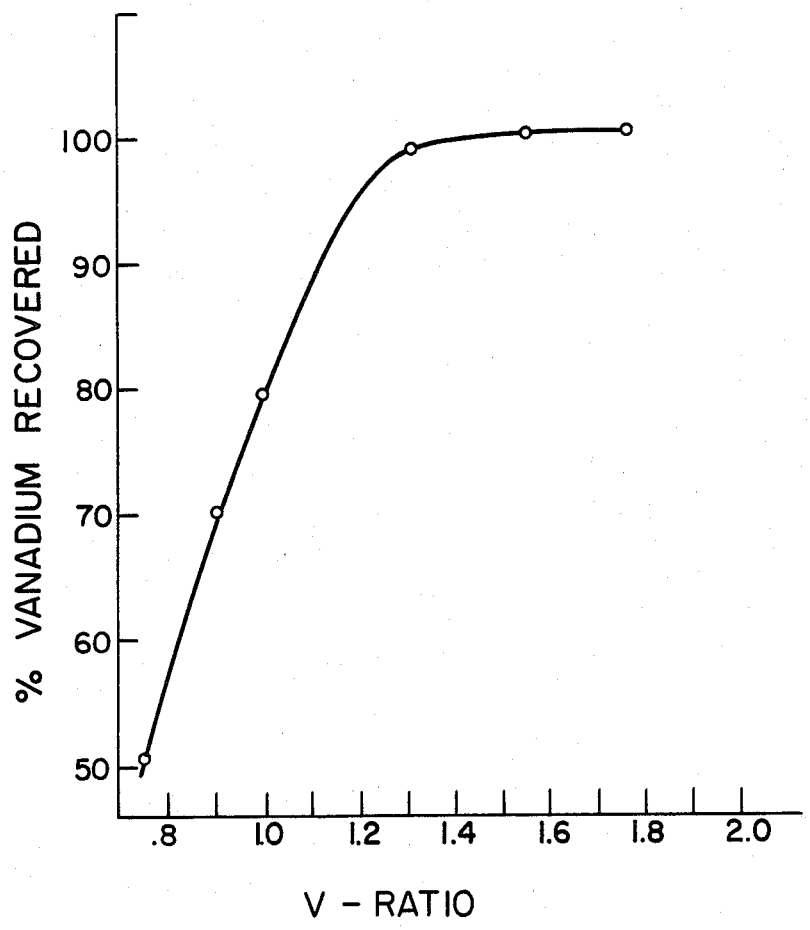
FIG. 6 is a graph showing the relationship between the weight ratio $CaO/SiO_2$ in the slag and the vanadium recovery.

FIG. 6 shows the effect of V-ratio on vanadium recovery from a $V_2O_3$ additive in the AOD based on a number of actual tests. It is seen that the highest recoveries were obtained when the V-ratio was above 1.3 and preferably between 1.3 and 1.8.

In the AOD process, $V_2O_3$ provides a beneficial source of oxygen as well as a source of vanadium. This allows the steelmaker to decrease the amount of oxygen injected into the AOD vessel and further decreases costs. A tabulation of the pounds of vanadium versus cubic foot of oxygen is shown in Table V.

TABLE V

| $V_2O_3$ (lbs.) | Vanadium (lbs.) | Oxygen (Cu. Ft. At 32° F.) |
|---|---|---|
| 29.4 | 20 | 105.5 |
| 22.1 | 15 | 79.14 |
| 14.7 | 10 | 52.75 |
| 1.47 | 1 | 5.28 |

It is possible of course to produce a $V_2O_3$ containing material other than by the chemical method disclosed in U.S. Pat. No. 3,410,652, supra. For example, $V_2O_3$ can be prepared by hydrogen reduction of $NH_4VO_2$. This is a two-stage reduction, first at 400°-500° C. and then at 600°-650° C. The final product contains about 80% $V_2O_3$ plus 20% $V_2O_4$ with a bulk density of 45 lb/cu. ft. The state of oxidation of this product is too high to be acceptable for use as a vanadium addition to steel.

The following examples will further illustrate the present invention:

EXAMPLE I 230 lbs. of vanadium as chemically prepared $V_2O_3$ powder was added to an AOD vessel containing an MI Grade tool steel melt weighing 47,500 lbs. Before the $V_2O_3$ addition, the melt contained 0.54 wt. % carbon and 0.70 wt. % vanadium. The slag had a V-ratio of 1.3 and weighed about 500 lbs. After the addition of the $V_2O_3$, aluminum was added to the molten steel bath. A mixture of argon and oxygen was then injected into the AOD vessel. The temperature of the steel bath was maintained at steel making temperatures by oxidation of the aluminum. After the injection treatment, a second sample was taken from the bath and analyzed. The sample contained 1.27 wt. % of vanadium. Based on the amount of $V_2O_3$ added and the analysis of the melt upon $V_2O_3$ addition, it was concluded that the vanadium recovery from the $V_2O_3$ under these conditions was approximately 100 percent. The alloy chemistry of the final product was: 0.74 wt. % C; 0.23 wt. % Mn; 0.36 wt. % Si; 3.55 wt. % Cr; 1.40 wt. % W; 1.14 wt. % V; and 8.15 wt. % Mo.

EXAMPLE II 150 lbs. of vanadium as chemically prepared $V_2O_3$ powder was added to an AOD vessel containing an M7 Grade tool steel melt weighing about 47,500 lbs. The melt contained 0.72 wt. % carbon and 1.57 wt. % vanadium before the $V_2O_3$ addition. The slag had a V-ratio of 1.3 and weighed about 800 lbs. Aluminum was added to the molten steel bath after the addition of $V_2O_3$. A mixture of argon and oxygen was then injected into the AOD vessel. The temperature of the steel bath was maintained at steel-making temperatures by oxidation of the aluminum. A second sample was taken after injection of the argon-oxygen mixture and was analyzed. The sample contained 1.82 wt. % of vanadium. Based on the amount of $V_2O_3$ added and the analysis of the melt before $V_2O_3$ addition, it was concluded that vanadium recovery from the $V_2O_3$ under these conditions was approximately 100%. The alloy chemistry of the final product was: 1.03 wt. % C; 0.25 wt. % Mn; 0.40 wt. % Si; 3.60 wt. % Cr; 1.59 wt. % W; 1.86 wt. % V; and 8.30 wt. % Mo.

EXAMPLE III 60 lbs. of vanadium as chemically prepared $V_2O_3$ powder was added to an AOD vessel containing an M2FM Grade tool steel melt weighing about 44,500 lbs. Before the $V_2O_3$ addition, the melt contained 0.65 wt. % carbon and 1.72 wt. % vanadium. The slag had a V-ratio of 0.75 and weighed about 600 lbs. After the addition of the $V_2O_3$, aluminum was added to the molten steel bath. A mixture of argon and oxygen was then injected into the AOD vessel. The temperature of the steel bath was maintained at steel-making temperatures by oxidation of the aluminum. After the injection of the argon-oxygen mixture, a second sample was taken from the melt and analyzed. The sample contained 1.78 wt. % vanadium. Based on the amount of $V_2O_3$ added and the analysis of the melt before $V_2O_3$ addition, it was concluded that the vanadium recovery from $V_2O_3$ under these conditions was approximately 54 percent. The alloy chemistry of the final product was: 0.83 wt. % C; 0.27 wt. % Mn; 0.30 wt. % Si; 3.89 wt. % Cr; 5.62 wt. % W; 1.81 wt. % V; and 4.61 wt. % Mo.

I claim:

1. A process for producing alloy steel which comprises:

(a) forming a molten alloy steel in an electric furnace;

(b) pouring the molten steel from the electric furnace into a transfer ladle;

(c) loading the molten steel from the transfer ladle into an AOD vessel;

(d) adding to the molten steel in the electric furnaace, transfer ladle or AOD vessel a vanadium additive consisting essentially of finely divided chemically prepared substantially pure $V_2O_3$;

(e) generating a slag covering the molten steel in the AOD vessel, the slag containing CaO and $SiO_2$ in a weight ratio of $CaO/SiO_2$ which is equal to or greater than unity.

(f) adding to the molten steel in the AOD vessel an oxidizable metal selected from the group consisting of aluminum and silicon or mixtures thereof; and (g) injecting a gaseous mixture of argon or nitrogen or both and oxygen into the AOD vessel, the proportion of argon or nitrogen to oxygen in the gaseous mixture being such as to continuously provide a reducing atmosphere in contact with the molten steel.

2. A process according to claim 1 wherein the weight ratio of $CaO/SiO_2$ in the slag is between about 1.3 and 1.8.

3. A process according to claim 1 wherein the oxidizable metal is added in any amount which upon oxidation will maintain the molten steel at steel-making temperatures.

4. In a process for producing alloy steel comprising forming a molten alloy steel in an electric furnace, pouring the molten steel from the electric furnace into a transfer ladle, loading the molten steel from the transfer ladle into an AOD vessel, generating a slag covering the molten steel in the AOD vessel which slag contains CaO and $SiO_2$, and injecting a gaseous mixture of argon or nitrogen or both and oxygen into the AOD vessel, the proportion of argon or nitrogen to oxygen in the gaseous mixture being such as to continuously provide a reducing atmosphere in contact with the molten steel; the improvement which comprises:

(a) adding to the molten steel in the electric furnace, transfer ladle or AOD vessel as a vanaduium additive a finely divided, chemically prepared substantially pure $V_2O_3$ without a reducing agent admixed in intimate contact therewith;

(b) adjusting the proportion of CaO and $SiO_2$ in said slag so that the weight ratio of $CaO/SiO_2$ is equal to or greater than unity, and (c) adding to the molten steel in the AOD vessel an oxidizable metal selected from the group consisting of aluminum and silicon or mixtures thereof.

5. In a process for producing alloy steel comprising forming a molten alloy steel in an electric furnace, pouring the molten steel from the electric furnace into a transfer ladle, loading the molten steel from the transfer ladle into an AOD vessel, generating a slag covering the molten steel in the AOD vessel which slag contains CaO and $SiO_2$, and injecting a gaseous mixture of argon or nitrogen or both and oxygen into the AOD vessel, the proportion of argon or nitrogen to oxygen in the gaseous mixture being such as to continuously provide a reducing atmosphere in contact with the molten steel, the improvement which comprises:

(a) adding to the molten steel in the electric furnace, transfer ladle or AOD vessel as a vanadium additive a finely divided, chemically prepared, substantially pure $V_2O_3$ without a reducing agent admixed in intimate contact therewith, said finely divided $V_2O_3$ having a surface area greater than about $8\times10^3$ sq. centimeters per cubic centimeter and a bulk density of about 70 to 77 pounds per cubic foot;

(b) adjusting the proportion of CaO and $SiO_2$ in said slag so that the weight ratio of $CaO/SiO_2$ is between about 1.3 and 1.8; and (c) adding to the molten steel in the AOD vessel an oxidizable metal selected from the group consisting of aluminum and silicon or mixtures thereof.

6. A process according to claim 5 wherein the oxidizable metal is added in an amount which upon oxidation will maintain the molten steel at steel-making temperatures.

7. A process according to claim 5 wherein 50 weight percent of the finely divided $V_2O_3$ has a particle size distribution of between about 4 and 7 microns.

8. A process according to claim 5 wherein the finely divided $V_2O_3$ has a void volume of from about 75 to 80 percent.

* * * * *

UNITED STATES PATENT AND TRADEMARK OFFICE

CERTIFICATE OF CORRECTION

PATENT NO. : 4,526,613

DATED : July 2, 1985

INVENTOR(S) : Gloria M. Faulring

It is certified that error appears in the above—identified patent and that said Letters Patent is hereby corrected as shown below:

Title page, col. 1, lines 8 and 9, "Assignee: Union Carbide Corporation, Danbury, Conn." should read -- Assignee: Umetco Minerals Corporation, Danbury, Conn. --

Col. 5, line 5, "a" should be deleted.

Col. 9, line 38, "any" should read -- an --.

Signed and Sealed this

*Eleventh* Day of *February 1986*

[SEAL]

*Attest:*

DONALD J. QUIGG

*Attesting Officer*

*Commissioner of Patents and Trademarks*